US005568992A

United States Patent [19]

Grembowicz et al.

[11] Patent Number: 5,568,992

[45] Date of Patent: Oct. 29, 1996

[54] SCREED CONTROL SYSTEM FOR AN ASPHALT PAVER AND METHOD OF USE

[75] Inventors: Conrad G. Grembowicz; Alan L. Ferguson, both of Peoria; Wade D. Samson; Keith R. Schmidt, both of Sycamore, all of Ill.

[73] Assignee: Caterpillar Paving Products Inc., Minneapolis, Minn.

[21] Appl. No.: 444,945

[22] Filed: May 19, 1995

[51] Int. Cl.[6] ..... E01C 19/12

[52] U.S. Cl. ..... 404/101; 404/84.05; 404/84.1; 404/103

[58] Field of Search ..... 404/84.1, 72, 75, 404/96, 102, 118; 172/2, 4.5

[56] References Cited

U.S. PATENT DOCUMENTS

| | | | |
|---|---|---|---|
| 4,682,908 | 7/1987 | Domenighetti | 404/84 |
| 4,688,965 | 8/1987 | Smith et al. | 404/75 |
| 4,722,636 | 2/1988 | Brock | 404/84 |
| 4,759,657 | 7/1988 | Dorr et al. | 404/72 |
| 4,854,769 | 8/1989 | Fukukawa et al. | 404/72 |
| 4,948,292 | 8/1990 | Haven et al. | 404/84 |
| 5,203,642 | 4/1993 | Heller et al. | 404/118 |
| 5,222,829 | 6/1993 | Mogler et al. | 404/118 |
| 5,232,305 | 8/1993 | Bassett et al. | 404/101 |
| 5,393,167 | 2/1995 | Fujita et al. | 404/84.1 |

*Primary Examiner*—Tamara L. Graysay
*Assistant Examiner*—Pamela A. O'Connor
*Attorney, Agent, or Firm*—David M. Masterson; Mario J. Donato

[57] ABSTRACT

In one aspect of the present invention, a control system for a floating screed assembly for an asphalt paving machine is disclosed. The screed assembly includes a main screed and extension screed unit. An electrohydraulic device extends and retracts, as well as, raises and lowers the extension screed unit relative to the main screed unit. The electrohydraulic device additionally pivots the extension screed unit relative to the main screed unit about a horizontal axis. Position sensors produce position signals in response to the position of the extension screed unit. A controller receives the position signals and produces command signals to control the extending, retracting, and pivoting of the extension screed unit to a desired position.

8 Claims, 6 Drawing Sheets

SCREED CONTROL SYSTEM FOR AN ASPHALT PAVER AND METHOD OF USE

TECHNICAL FIELD

This invention relates generally to a screed control system for an asphalt paver of the floating screed type equipped with an adjustable screed extender.

BACKGROUND ART

Typically, floating screed pavers are comprised of a self-propelled paving machine having a hopper at its forward end for receiving material from a dump truck which is pushed along the roadbed by the paver. The truck progressively dumps its load of paving material into the hopper.

A conveyor system on the paver transfers the material from the hopper for discharge on the roadbed. Screw augers then spread the material in front of the screed. The screed is commonly connected to the paving machine by pivoting tow or draft arms, which allows the screed to "float" on the paving material. Accordingly, the screed is commonly referred to as a "floating screed".

The screed functions to level, compact, and set the width of the paving material distributed by the augers; ideally leaving the finished road with a uniform and smooth surface. The height of the tow points on each side of the paver and the angle of attack of the screed may be varied to control the thickness and slope of the paving mat.

For many paving activities, the effective paving width of the screed is adequate. However, for other paving activities, there is a desire to widen the effective paving width of the screed. Consequently, "extendable" screed units have been attached to the main screed unit where the paving width varies and/or there are obstacles to be paved around. Moreover, there has further been a need to provide pivotal movement of the extension screed unit in order to form a sloped shoulder or berm at the edge of the road.

Heretofore, prior art paving machines provide for mechanical control over the screed assembly. Such machines require skilled operators for monitoring and adjusting the extension screed, including such parameters as: the width, height and slope of the extension screed. Moreover, an adjustment of one of the parameters effects other parameters, which may require re-adjustment of the other parameters. Accordingly, it is desirable to provide electrohydraulic technology to automatically control the screed adjustment parameters. It is further desirable to provide for microprocessor control to automatically control the paving width, height, and slope to provide for more accurate positioning of the extension screed unit.

DISCLOSURE OF THE INVENTION

In one aspect of the present invention, a control system for a floating screed assembly of a paving machine is disclosed. The screed assembly includes a main screed and extension screed unit. An electrohydraulic device extends and retracts the extension screed unit relative to the main screed unit. The electrohydraulic device additionally pivots the extension screed unit relative to the main screed unit about a horizontal axis. Position sensors produce position signals in response to the position of the extension screed unit. A controller receives the position signals and produces command signals to control the extending, retracting, and pivoting of the extension screed unit to a desired position.

BRIEF DESCRIPTION OF THE DRAWINGS

For a better understanding of the present invention, reference may be made to the accompanying drawings in which.

BEST MODE FOR CARRYING OUT THE INVENTION

Figure 1:
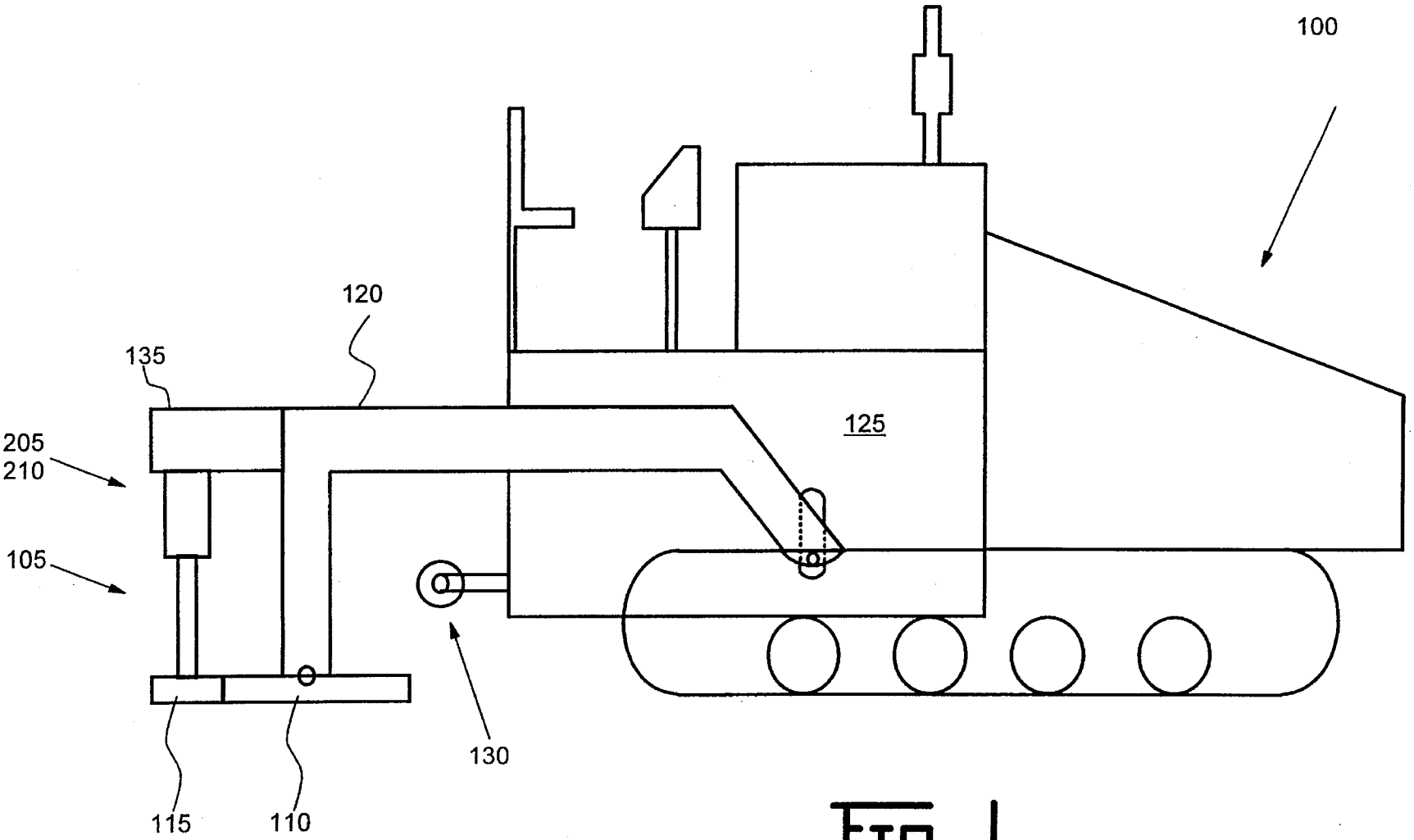
FIG. 1 is a side view of an asphalt paving machine having a floating screed assembly.

Referring now to the drawings, FIG. 1 illustrates a paver, which may be of the rubber tire or crawler track type, is generally designated by 100 and includes a floating screed assembly, generally designated by 105. The floating screed assembly preferably consists of a main screed 110 and an extendable screed 115. Further, the main screed 110 is formed in two sections, one on each side of the center line of the paver. Consequently, an extension screed 115 is mounted to each of the main screed sections. The screed assembly 105 embodying the present invention is generally of the type shown in U.S. Pat. No. 5,203,642 assigned to the Barber-Greene Company, which is hereby incorporated by reference. Since the screed assembly 105 of the present invention is symmetrical with respect to the longitudinal centerline of the paver, the invention will be described with reference to only one of the main screed sections and the associated extension screed, it being understood that similar components will be included on the other side of the screed assembly.

The right main screed section 110 is connected to one of the payer's draft arms 120. The other end of the draft arm 120 is pivotally connected to the chassis 125 of the paver in a manner for towing the floating screed assembly 105. The main screed includes an integral support assembly, a.k.a., a screed extension carriage 135, for mounting the extension screed 115. As shown, the extension screed 115 is mounted rearwardly of the main screed unit; although the extension screed 115 may be mounted in front of the main screed unit.

Figure 2:
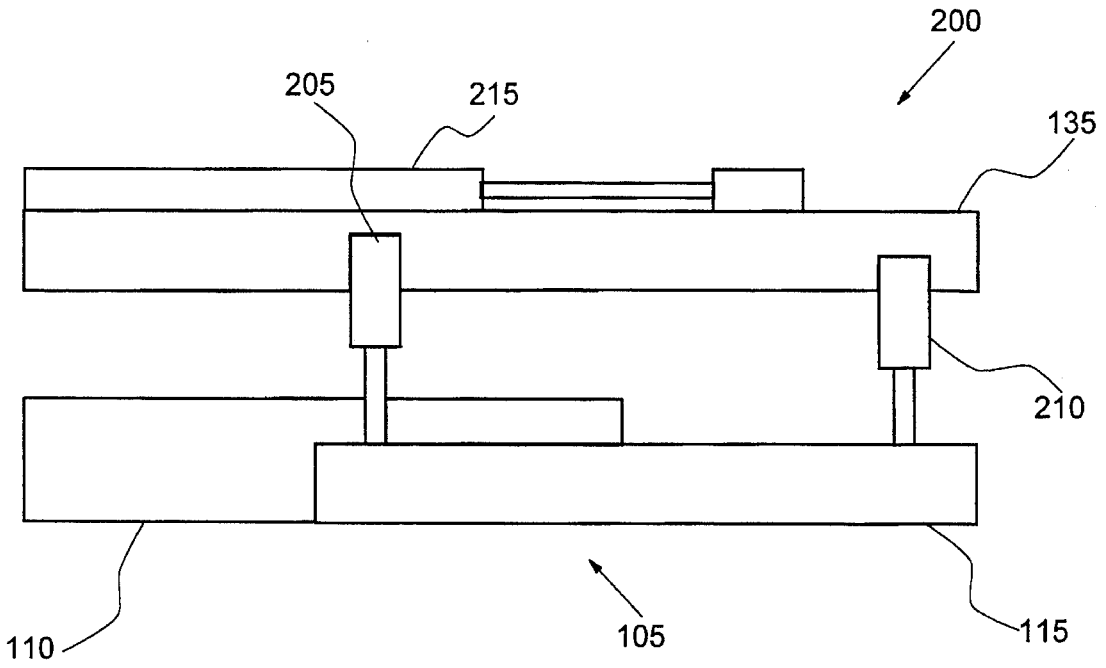
FIG. 2 is a rear view of the screed assembly.

A right-hand rear view of the screed assembly 105 is shown in FIG. 2. A hydraulic means 200 is provided for extending, retracting, raising, lowering, and pivoting the extension screed 115, relative to the main screed 110. The hydraulic means 200 includes hydraulic cylinders (A,B) 205,210 for raising and lowering the extension screed 115, and cylinder (C) 215 for extending and retracting the extension screed 115.

Figure 3:
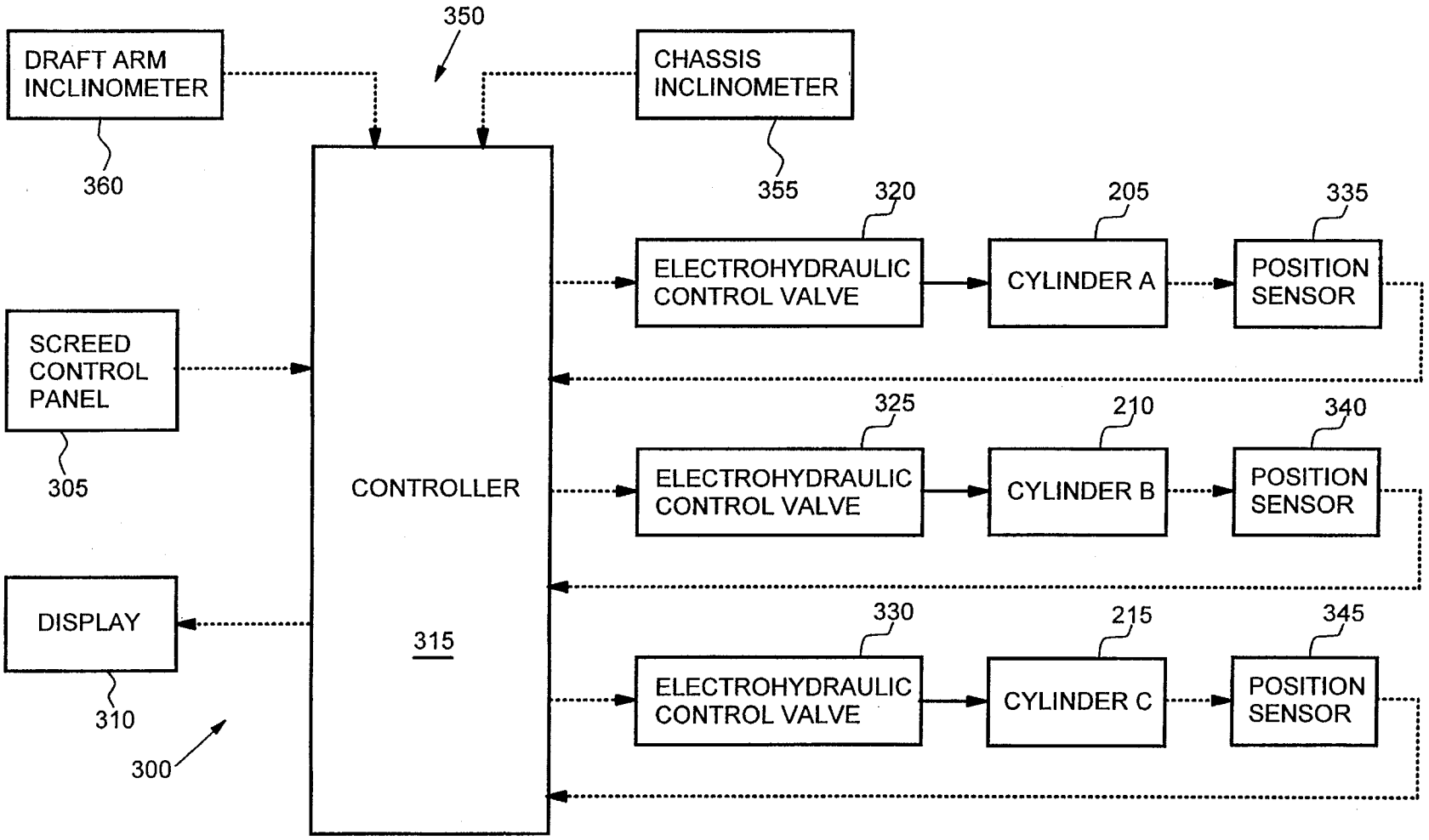
FIG. 3 is a hardware block diagram of an electrohydraulic control system.

Referring now to FIG. 3, a block diagram of an electrohydraulic control system 300 associated with the present invention is shown. A screed control panel 305 provides for manual actuation of the extension screed units. For example, the screed control panel 305 may includes a series of switches, function keys, or the like to manually control the raising, lowering, extending, retracting and pivoting of the extension screed units. A display 310 may also be provided to numerically display the slope, height, and extension of the extension screed units. Accordingly, the screed control panel 305 produces operator control signals that are received by a controller 315. The controller 315 is a microprocessor based system that receives the operator control signals and produces command signals that are received by electrohydraulic control valves 320,325,330 The electrohydraulic control valves 320,325,330 are solenoid actuated in order to control the flow of hydraulic fluid to extend or retract the associated hydraulic cylinders.

Position sensors 335,340,345 are provided to sense the amount of cylinder extension of the respective hydraulic cylinders and deliver linear position signals to the controller 315. The position sensors may be one of several well known linear displacement transducers.

A rotary sensor 350 may be provided to sense the angle of the draft arm 120 relative to the chassis 125 and deliver a angular position signal to the controller 315. The rotary sensor 350 may take various forms including a rotary potentiometer. Moreover, the rotary sensor 350 may include an inclinometer. For example, a chassis inclinometer 355 and a draft arm inclinometer 360 may be provided to sense the inclination of the chassis 125 and draft arm 120, respectively. Accordingly, the inclinometers 355,360 may deliver respective angular position signals to the controller 315.

Thus, while the present invention has been particularly shown and described with reference to the preferred embodiment above, it will be understood by those skilled in the art that various additional embodiments may be contemplated without departing from the spirit and scope of the present invention.

INDUSTRIAL APPLICABILITY

The operation of the present invention is now described to illustrate its features and advantages.

Figure 9:
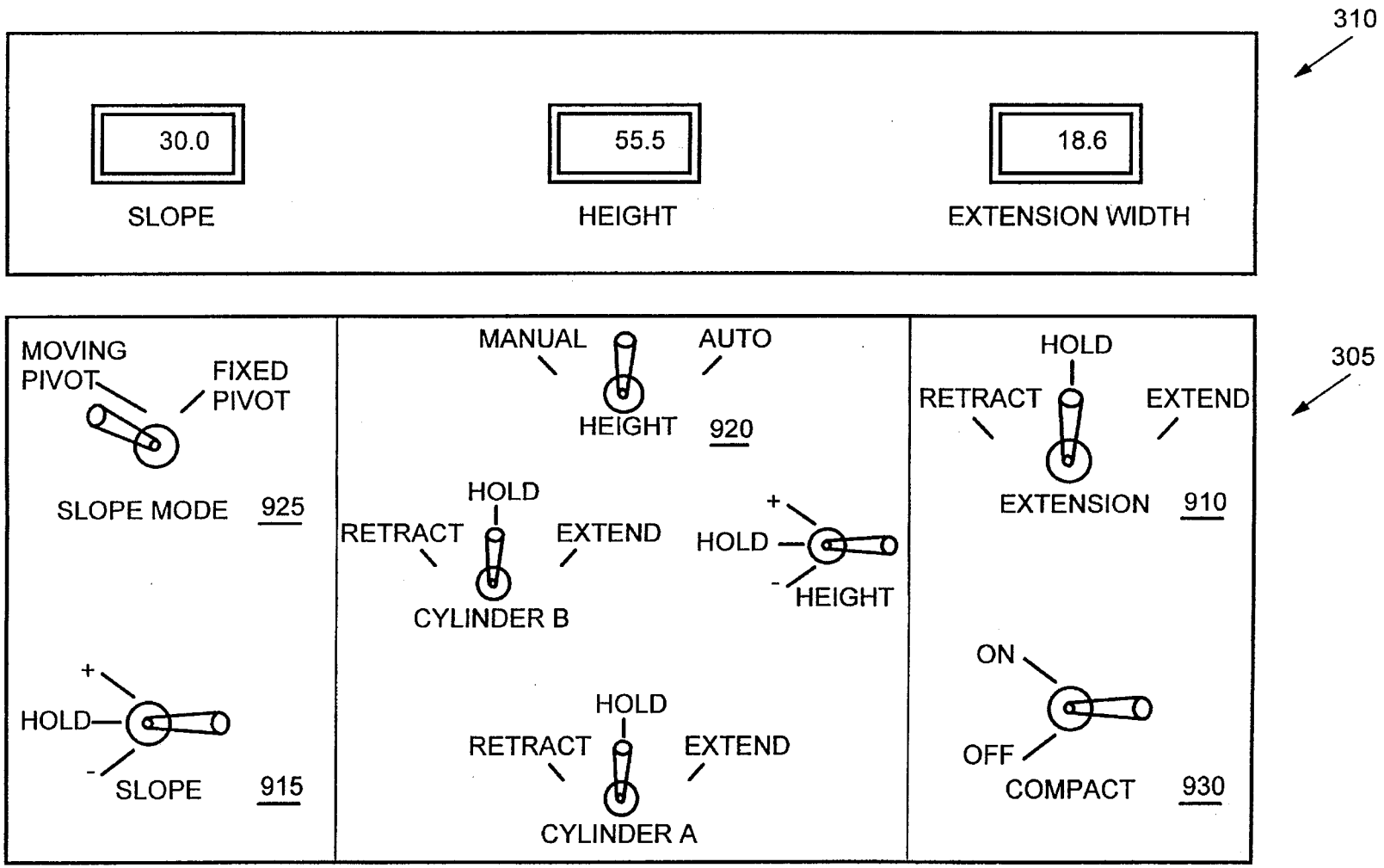
FIG. 9 is an illustrative view of an operator control panel.

Referring now to FIG. 9, the (right extension) screed control panel 305 is shown. Control of the screed assembly 105 is typically exercised from a pair of operator control panels, which are located near the screed assembly 105 and are serviced by a person other than the paver operator. The present invention not only provides for manual control of the extension screed 115, but advantageously provides for automatic control of the extension screed 115 via several automatic functions.

Figure 4:
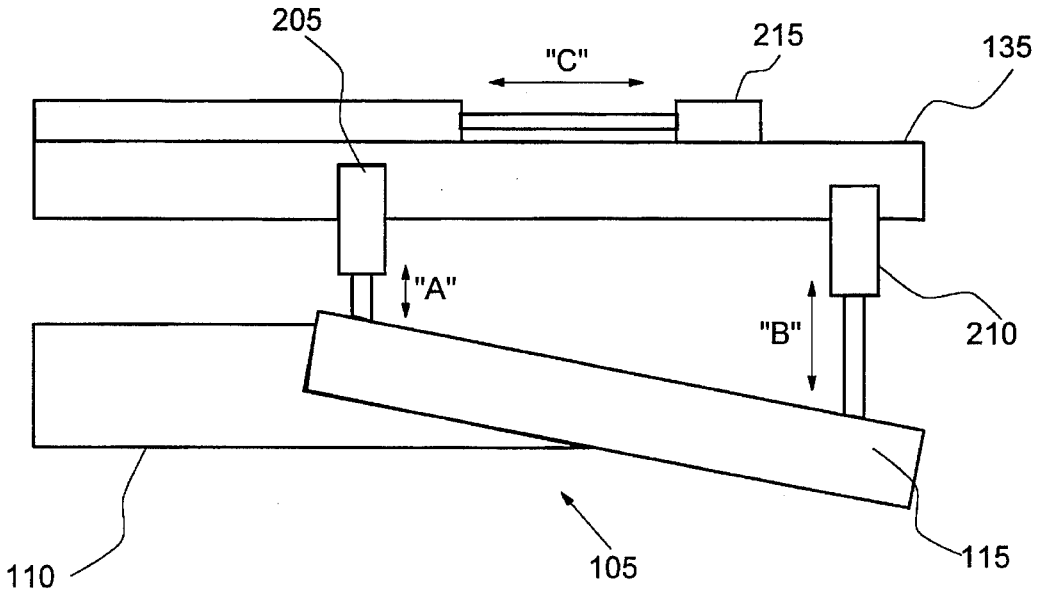
FIG. 4 is a rear view of the screed assembly, where the extension screed unit is shown pivoting.

Reference is now made to FIG. 4, where a rear view of the screed assembly 105 is illustrated. As shown by the arrows, the controller produces command signals to cause the extension and retraction (shown by the "C" arrow), as well as, the raising, lowering and/or pivoting (shown by the "A" and "B" arrows) of the extension screed 115 in response to operator control signals. For example, the operator may modify the desired paving width via an extension switch 910, or modify a sloped shoulder via a slope switch 915. Accordingly, the controller 315 receives the operator control and position signals, makes the necessary calculations, and produces the required command signals to cause the desired positioning of the extension screed 115.

Further, the present invention provides for automatic positioning of the extension screed pivot point while the extension screed 115 is being retracted or extended. The screed pivot point represents the location where the main and extension screed wear plates intersect. To accomplish the above, the operator simply selects the "auto" mode with the screed mode switch 920, and selects the desired slope mode, "moving pivot" or "fixed pivot" with the slope mode switch 925.

Figure 5:
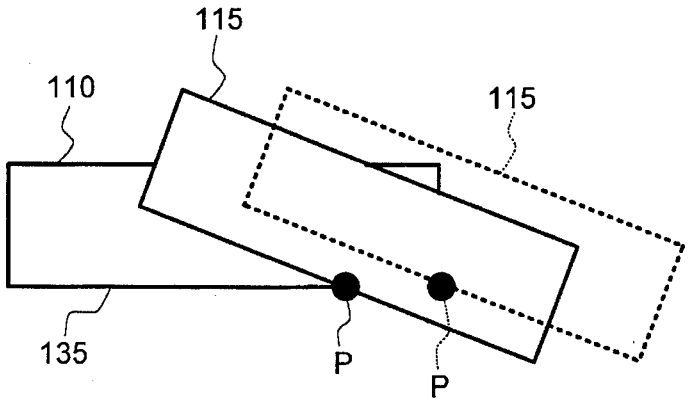
FIG. 5 is a rear view of the screed assembly shown to show a moving pivot operation.

Reference is now made to FIG. 5 to illustrate the moving pivot mode. In this example, the controller 315 causes cylinder C to retract in order to move the extension screed 115 from the position shown in phantom to a desired position (shown in solid lines). Note that, the extension screed 115 moves along a horizontal axis that is defined by the main screed wear plate. Thus, in the moving pivot mode, the controller 315 "locks" the cylinders A and B in place while cylinder C is retracted or extended to maintain the slope of the extension screed 115 at a constant slope. Accordingly, the pivot point, P, moves along the main screed plate 135 as the extension screed 115 is linearly positioned. Moreover, as the extension screed 115 is positioned, the screed display 310 is continuously updated to show the actual extension screed position.

Figure 6:
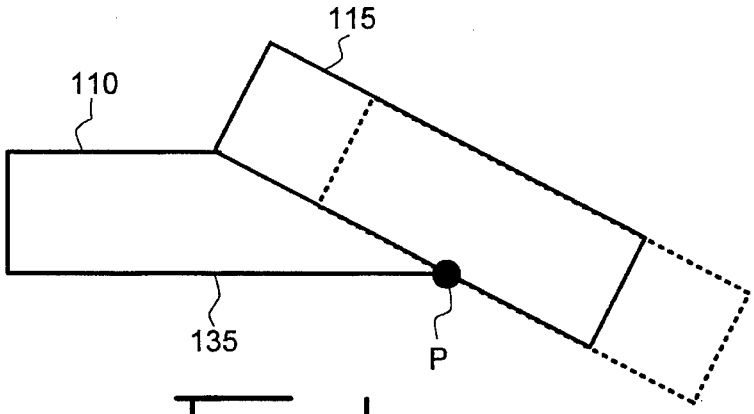
FIG. 6 is a rear view of the screed assembly to show a fixed pivot operation.

Reference is now made to FIG. 6, to illustrate the fixed pivot mode. In this example, the controller 315 adjusts cylinders A, B, to maintain a constant slope of the extension screed 115 while cylinder C is retracted to position the extension screed 115 from the position shown in phantom to the desired position (shown in solid lines). Accordingly, the pivot point, P, is maintained at the end of the main screed wear plate as the extension screed 115 is linearly re-positioned.

Figure 7:
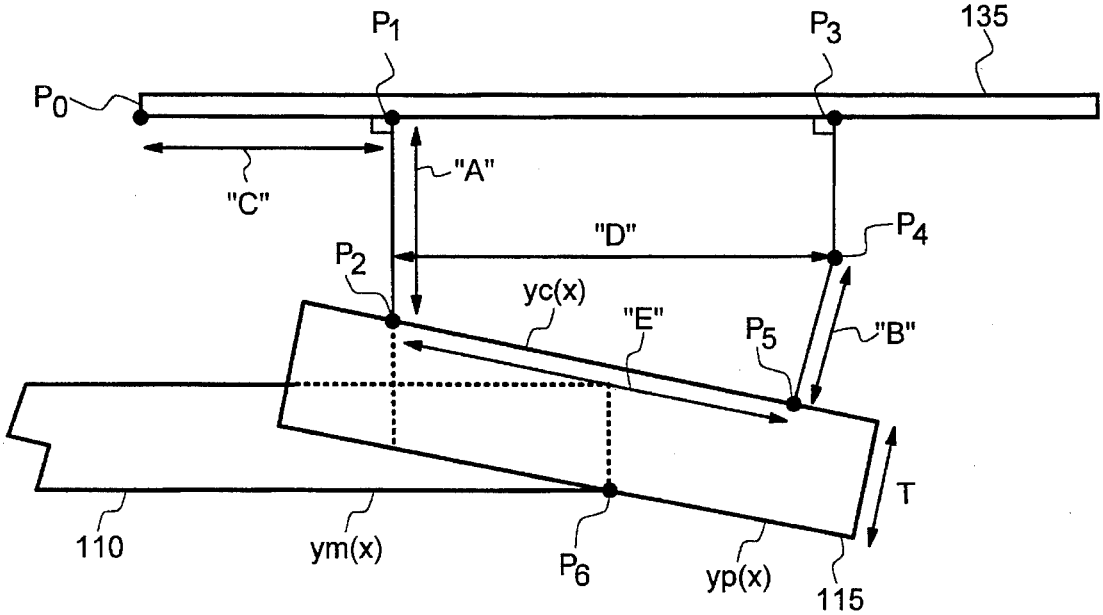
FIG. 7 is a mathematical model of the screed assembly.

To better illustrate how the controller 315 performs the required calculations associated with the fixed pivot mode, reference is made to FIG. 7 which illustrates a mathematical model of the screed assembly. The mathematical model definitions are as follows:

Defined Points:

- $P_0$ $(X_0, Y_0)$ represents the location of point $P_1$ when cylinder C is fully retracted;
- $P_1$ $(X_1, Y_1)$ represents the location where cylinder A connects to the extension screed carriage;
- $P_3$ $(X_3, Y_3)$ represents the location where the support for cylinder B connects to the extension screed carriage; and
- $P_4(X_4, Y_4)$ represents the location where cylinder B connects to the cylinder support.

Variable Points:

- $P_2$ $(X_2, Y_2)$ represents the location where cylinder A connects to the top of the extension screed;
- $P_5(X_5, Y_5)$ represents the location where cylinder B connects to the top of the extension screed; and
- $P_6(X_6, Y_6)$ represents the location where the main screed plate line $Y_m(X)$ intersects the extension plate line $Y_p(X)$ .

Lines:

- $Y_m(X)$ represents the line formed by the bottom plate of the main screed;
- $y_c(X)$ represents the line formed by the top of the extension screed;
- $y_p(X)$ represents the line formed by the bottom of the extension screed; where:
  - the corresponding slopes are $m_m$, $m_0$ and $m_p$, respectively; and
  - the corresponding "Y" intercepts are $k_m$, $k_0$and $k_p$, respectively.

Fixed Distances:

- "D" represents the distance between cylinder A and the support for cylinder B;
- "E" represents the distance between points $P_2$ and $P_5$; and "T" represents the thickness of the extension screed.

Variable Distances (measured or calculated):

"A" represents the extension length of cylinder A from $P_1$ to $P_2$;

"B" represents the extension length of cylinder B from $P_4$ to $P_5$; and

"C" represents the extension length of cylinder C from $P_0$ to $P_1$.

Calculations:

The extension screed may be automatically positioned in accordance with two general steps:

(1) calculate the extension screed line $Y_p(X)$ and the main screed/extension screed pivot point $P_6$ in response to the extension of cylinders A, B, C (and the fixed geometry relationships of the screed assembly); and (2) calculate the desired extension of cylinders A, B, and C in order to automatically position the extension screed to the desired position based on the extension screed line $Y_p(X)$ and pivot point $P_6$.

Once the desired cylinder extensions have been calculated, the controller utilizes a closed loop control strategy to precisely adjust each cylinder in order to position the extension screed at the desired location.

Note that, the extension screed line $Y_p(X)$ and pivot point $P_6$ may be determined directly or indirectly. For example, an additional sensor may be included to directly measure the angle or slope of the extension screed relative to the main screed. Because the actual extension screed slope, as well as, the cylinder lengths may be directly measured, the extension screed line $Y_p(X)$ and pivot point $P_6$ may be directly determined. However, if a extension screed angle sensor is not employed, then the extension screed line $Y_p(X)$ and pivot point $P_6$ may be indirectly determined based on the measured cylinder lengths. The method described below pertains to indirectly determining the extension screed line $Y_p(X)$ and pivot point $P_6$. To simplify nhe below calculations, the screed position is assumed to be a two dimensional model with the "X" axis being parallel cylinder C and the "Y" axis being parallel to cylinder A. Note, the reference origin, $P_0$, is the location where cylinder A meets a fully retracted cylinder C. Main Screed Line $Y_m(X)$ Before the main screed line can be determined, the fixed geometries of the screed assembly must be determined by using a calibration process. First, the operator fully retracts the extension screed via cylinder C, then he adjusts cylinders A and B until the main and extension screed plates are co-planer. All three cylinder lengths are then stored in the controller. This is referred to as calibration #1.

The operator then extends cylinder C, until a mark on the extension screed is aligned with the edge of the main screed. Accordingly, the length of cylinder C is stored in the controller. This is referred to as calibration #2.

The main screed line $Y_m(X)$ and pivot point $P_6$ may now be calculated in accordance with the following steps:

(1) Determine point $P_2$ as a function of:
$X_2$=calibration #1, length "C"
$Y_2$=calibration #1, length "A"

(2) Determine point $P_4$ as a function of:
$X_4=X_2+$"$D$"
$Y_4$=a predetermined value (3) Determine point $P_5$ in response to points $P_2$ and $P_4$ as a function of:

$$Y_5=Y_4+B\sin(\xi+\delta)$$
$$X_5=X_4-B\cos(\xi+\delta)$$

where:

$$\delta=\tan^{-1}(\bar{\omega}/D)$$
$$\xi=\cos^{-1}((-E^2+(D^2+\bar{\omega}^2)+B^2)/(2B(D^2+\bar{\omega}^2)^{0.5}))$$
$$\bar{\omega}=(Y_5-Y_4)$$

(4) Determine line $Y_c(X)$ in response to points $P_2$ and $P_5$ according to the following line equation:

$$Y_c(X)=((Y_5-Y_2)/(X_5-X_2))X+X_2((Y_5+Y_2)/(X_5X_2))$$

(5) Determine line $Y_p(X)$ in response to $Y_c(X)$, according to the following equation:

$$Y_p(X)=m_cx+(k_c+T(1+m_c)^2)^{0.5}$$

where:

$m_c=(Y_5-Y_2)/(X_5-X_2)$; and
$k_c=X_2(Y_5+Y_2)/(X_5-X_2)$ .

(5) Determine line $Y_m(X)$ in response to $Y_p(X)$, where:

$$Y_m(X)=Y_p(X)$$

Note, during calibration 1, the main and extension screed plates become co-planer. Thus, the main screed line $Y_m(X)$ and the extension screed plate line $Y_p(X)$ are equal.

(6) Determine point $P_6$ in response to main screed line slope "$M_m$" and y intercept "$k_m$", according to the following equation:

$$Y_6=M_mX_6+k_m$$

where:

$k_m=(k_c+T(1+m_c)^2)^{0.5}$; and
$X_6$=calibration #2, length "C".

For a Changing Extension Screed Slope

Once that the pivot point $P_6$ and the equation for the main screed line $Y_m(X)$ are known, the desired extension screed position may be calculated in response to a change in the extension screed slope. Note, the following assumes that the extension width is constant, i.e., the cylinder C length remains unchanged. Accordingly, the desired cylinder lengths A and B may be calculated as follows:

(1) Determine the new screed plate line in response to new slope ($m_n$) and the original pivot point $P_6$ according to the point-slope line equation:

$$Y_{pn}(X)=m_nx+(Y_6-m_nX_6)$$

(2) Determine the desired cylinder length A (or $Y_n(c)$) in response to the new cylinder line $Y_{cn}(X)$ and the screed width (cylinder C length), according to the following equation:

$$Y_{pn}(c)=m_nc+(Y_6-m_nX_6)-T(1+(m_n)^2)^{0.5}$$

(3) Determine the desired cylinder length B (or $b_n$) according to the following equation:

$$b_n=((X_{5n}-X_4)^2+(Y_{5n}-Y_4)^2)^{0.5}$$

where:

$X_{5n}=X_{2n}+E/((1+m_n)^2)^{0.5}$; and
$Y_{5n}=Y_{2n}+E\,m_n/((1+(m_n)^2)^{0.5}$.

Note: The 'n' subscript is used to distinguish between a new and previous value for a variable. For example, $X_{2n}$ is the new value for variable $X_2$.

For a Changing Extension Screed Width

Once that the pivot point $P_6$ and the equation for the main screed line $Y_m(X)$ are known, the desired extension screed position may be calculated in response to a change in the extension screed width. Note, the following assumes that the extension screed slope is unchanged. Accordingly, the desired cylinder lengths A, B and C may be calculated as follows:

(1) The desired cylinder length C is simply determined in proportion to the desired screed extension width (because the cylinder length C is directly related to the screed extension width).

(2) Determine the desired cylinder length A (or $Y_{cn}(c)$) in response to the new cylinder line and the screed width (cylinder C length), according to the following equation:

$$Y_{cn}(C)=mc+(Y_6-mX_6)-T(1+(m)^2)^{0.5}$$

(3) Determine the desired cylinder length B (or $b_n$) according to the following equation:

$$b_n=((X_{5n}-X_4)^2+(Y_{5n}Y_4)^2)$$

where:

$X_{5n}=X_{2n}+E/((1+m)^2)^{0.5}$; and $Y_{5n}=Y_{2n}+Em/((1+(m)^2)^{0.5}$.

New Pivot Point

If the operator changes the extension screed position while in manual mode, a new pivot point may be formed. The pivot point ($P_6$) is defined as the intersection of the main screed line $Y_m(X)$ and the screed plate line $Y_p(X)$. If a new pivot point ($P_{6n}$) is formed, then the controller determines the new screed plate line ($Y_p(X)$), the intersection of the main screed line ($Y_m(X)$), and the screed plate line ($Y_p(X)$). Accordingly, the controller can determine new pivot point ($P_{6n}$). Once the new pivot point has been determined, the slope and width changes of the extension screed can be calculated as previously shown.

Attack Angle Function

Figure 8:
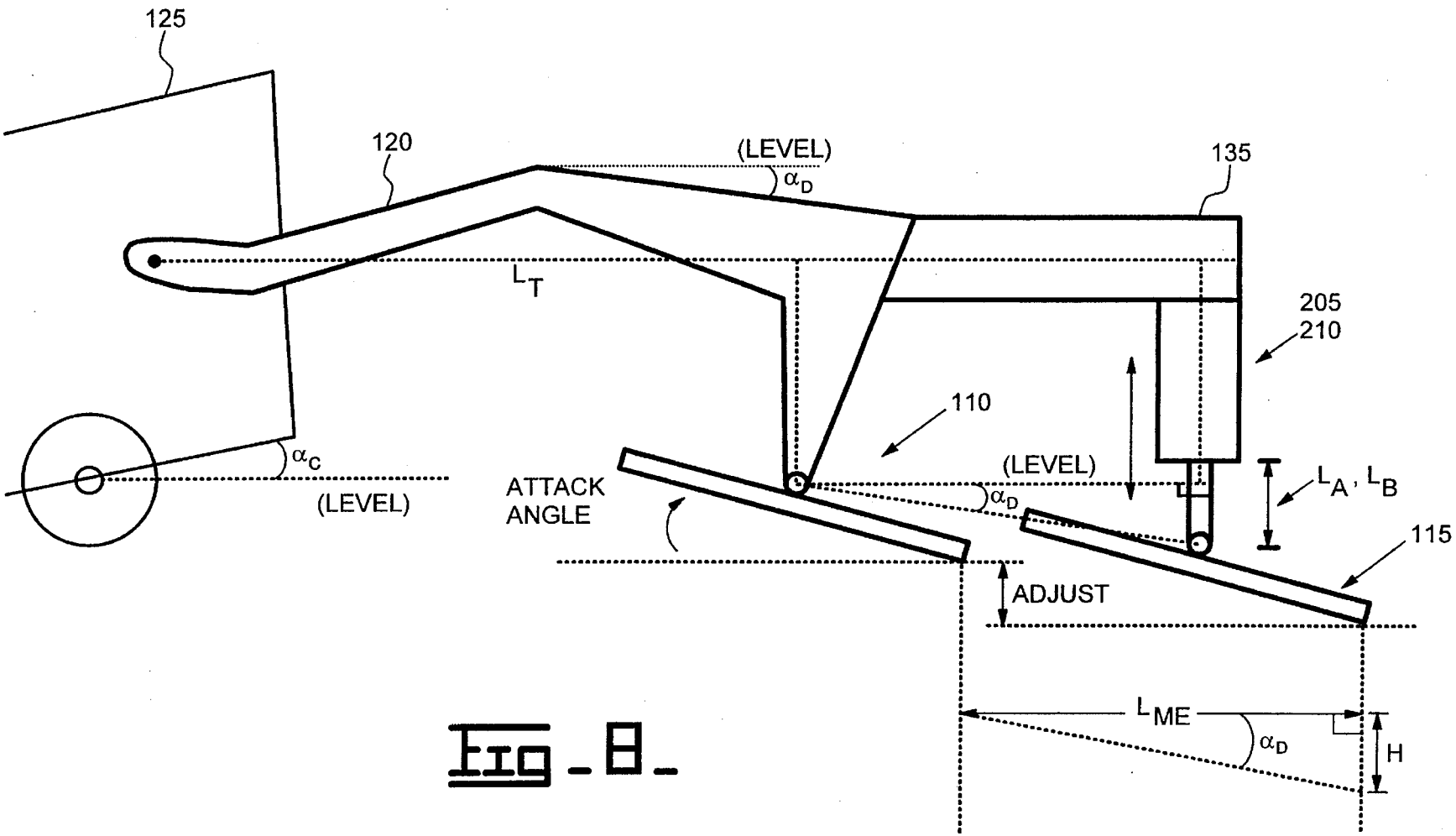
FIG. 8 is a side view of the screed assembly.

Reference is now made to FIG. 8, to illustrate another automatic screed mode operation referred to as the attack angle function. The attack angle function provides for automatic adjustment of the vertical position of the extension screed 115 as the position of the main screed 110 varies in order to maintain a predetermined alignment between the main and extension screed (which prevents the paved mat from scaring). Accordingly, as the main screed floats on the paving material, cylinders A and B are simultaneously adjusted to provide for the predetermined alignment.

The calculations associated with the attack angle function are now described. First, the attack angle variables are described below:

$L_{ME}$=Draft arm length $\alpha_{CO}$=Original chassis slope $\alpha_{DO}$=Original draft arm slope $H_O$=Original extension height factor $L_{AO}$, $L_{BO}$=Original cylinder length αCL =Later chassis slope αDL =Later draft arm slope $H_L$=Later extension height factor $L_{AL}$, $L_{BL}$=Later cylinder length To determine the required cylinder extensions of cylinders A and B to provide for the required vertical height of the extension screed 115, the controller 315 performs the following steps:

1. Calculate the original extension height factor, $H_O$:

$$H_O=L_{ME}\tan(\alpha_{co}-\alpha_{DO})$$

2. If either the chassis or draft arm changes their attitude, denoted by changes in $\alpha_{CL}$, $\alpha_{DL}$, respectively, a new height factor, $H_L$, is calculated:

$$H_L=L_{ME}\tan(\alpha_{CL}-\alpha_{DL})$$

3. Finally, the cylinder A and B extensions, $L_{AL}$, $L_{BL}$, are determined:

$$L_{AL}=L_{AO}+\Delta H$$

$$L_{BL}=L_{BO}+\Delta H$$

where $\Delta H=H_O-H_L$

Compaction Function

Yet another automatic screed operation may be performed, referred to as a compaction function. In response to the operator positioning a compact switch 930 to the "on" position, the controller 315 produces command signals that cause the cylinders A and B to simultaneously oscillate in order to compress the asphalt material. Consequently, a separate compaction means need not be used.

As described, the present invention provides for automatic control of the extension screed 115 via several automatic functions. Consequently, the present invention minimizes operator errors and provides for improved control over the extension screed. Other aspects, objects and advantages of the present invention can be obtained from a study of the drawings, the disclosure and the appended claims.

We claim:

1. A control system for a floating screed assembly for a paving machine comprising:

a screed assembly including a main screed unit and an extension screed unit;

a hydraulic cylinder for moving the extension screed unit relative to the main screed unit substantially transverse to the direction of machine travel;

a plurality of hydraulic cylinders for raising, lowering and pivoting the extension screed unit relative to the main screed unit;

operator control means for producing operator control signals indicative of a desired position of the extension screed unit;

a plurality of linear position sensor for sensing the linear extension of respective hydraulic cylinders and for producing position signals in response to the position of the extension screed unit; and a controller for receiving the operator control and position signals and delivering command signals to the hydraulic cylinders in order to control the position of the extension screed unit to the desired position.

2. A control system, as set forth in claim 1, including a draft arm for connecting the screed assembly to the chassis of the paving machine.

3. A control system, as set forth in claim 2, including an angular position sensor for sensing the angle of the draft arm relative to the paver chassis.

4. A control system, as set forth in claim 3, including a display means for numerically illustrating the actual position of the extension screed unit.

5. A method for automatically controlling a screed assembly of a floating screed paving machine, the screed assembly including a main screed and an extension screed unit, the method comprising the steps of:

producing operator control signals indicative of a desired position of the extension screed unit;

producing position signals in response to the actual position of the extension screed unit;

receiving the operator control and position signals, and producing command signals in order to control the position of the extension screed unit to the desired position; and automatically adjusting the vertical position of the extension screed unit in response to the attack angle of the main screed unit changing in order to maintain a predetermined alignment between the main and extension screed units.

6. A method, as set forth in claim 5, including the step of moving the pivot point of the extension screed unit horizontally with the travel of the extension screed unit in response to the extension screed unit being positioned linearly.

7. A method, as set forth in claim 6, including the step of maintaining the pivot point of the extension screed unit at a fixed position in response to the extension screed unit being positioned linearly.

8. A control system, as set forth in claim 7, including the step of oscillating the extension screed unit in order to compress the paving material.

* * * * *